United States Patent [19]

Blaisdell et al.

[11] Patent Number: 4,608,624

[45] Date of Patent: Aug. 26, 1986

[54] PROJECTION LAMP UNIT WITH SEPARABLE LAMP CAPSULE

[75] Inventors: Ronald G. Blaisdell, Saugus; Harold L. Hough, Beverly, both of Mass.

[73] Assignee: GTE Products Corporation, Stamford, Conn.

[21] Appl. No.: 693,566

[22] Filed: Jan. 22, 1985

[51] Int. Cl.[4] ..... H01R 33/00

[52] U.S. Cl. ..... 362/226; 362/306

[58] Field of Search ..... 362/226, 263, 306, 296

[56] References Cited

U.S. PATENT DOCUMENTS

| | | | |
|---|---|---|---|
| 1,712,217 | 5/1929 | Kelsea | 362/226 X |
| 3,639,750 | 2/1972 | Anthonijsz | 362/226 |
| 4,347,554 | 8/1982 | Matsushita | 362/263 X |
| 4,389,700 | 6/1983 | Blaisdell et al. | 362/306 |
| 4,390,935 | 6/1983 | Audesse et al. | 362/306 |
| 4,500,946 | 2/1985 | Mikola | 362/226 |

*Primary Examiner*—Willis R. Wolfe, Jr.

*Attorney, Agent, or Firm*—Lawrence R. Fraley

[57] ABSTRACT

A projection lamp unit 10 including a reflector (11) having a concave reflecting portion (13) and a rearward extending neck portion (15). Secured to the reflector is an insulative socket (23) in which is contained a pair of electrical contacts (31). Each contact includes a female receiving portion designed to receive the corresponding male pins (35) of an electrical lamp (39) which is inserted through the reflector's forward opening (17). Removal of the lamp (39) is possible simply by grasping the envelope (61) of the lamp (39) and pulling forward. Replacement of a similar lamp is then possible.

10 Claims, 4 Drawing Figures

PROJECTION LAMP UNIT WITH SEPARABLE LAMP CAPSULE

TECHNICAL FIELD

The invention relates to projection lamp units for use in projection systems such as microfilm viewers, slide and movie projectors, and track and recessed accent lighting.

BACKGROUND

In many projection lamp units which include a preformed glass reflector and projection lamp capsule (e.g., tungsten halogen) therein, the lamp capsule is retained in alignment within the reflector by employing a suitable cement (e.g., Sauereisen) within the reflector and about the lamp's sealed end. Examples of such arrangements are shown in U.S. Pat. Nos. 3,314,331 (Wiley) and 3,639,750 (Anthonijsz). Use of cement or a similar permanent-type bonding agent prohibits separation of the lamp capsule and reflector in the event that replacement of either of these components is necessary. In almost all cases, it is only the incandescent lamp capsule which fails and needs replacement. The aforementioned permanent bond between lamp and glass reflector was believed essential to assure precise alignment between said components and between these members and other elements (e.g., film gate, projection lens) within the system using the lamp unit. In those systems not utilizing such elements, precise lamp-reflector alignment is believed essential to provide accurately directed light onto the object(s) being illuminated. This is particularly true in track and recessed accent lighting. Alignment between the reflector and lamp was usually achieved using a precisioned instrument whereupon the assembled unit was ready for being inserted within a respective socket holder arrangement, such as shown in U.S. Pat. No. 3,789,212 (Wagner). This latter positioning is usually accomplished by the projector's operator.

Mandatory replacement of both lamp and glass reflector has therefore resulted in unnecessary waste of material which in turn has added appreciably to the overall cost of operating such systems.

The projection unit of U.S. Pat. No. 4,156,901 (Haraden et al) was designed to eliminate the above undesired requirement by providing a retention member which is removable from within the reflector yet which also assures positive alignment of the unit's incandescent lamp within the reflector when said lamp is positioned therein. The retention member is secured to the lamp's sealed end and comprises a metallic "can", a preformed component of insulative material such as ceramic, or a combination of both. One particular disadvantage of the unit described in U.S. Pat. No. 4,156,901 is the requirement for providing grooves, slots, etc. within the reflector's elongated neck portion to accommodate the retention member, which in turn included protruding tabs or similar items for being finally positioned within these grooves. Yet another disadvantage of the unit of U.S. Pat. No. 4,156,901 is that the reflector opening to accommodate the unit's retention member must be relatively large, thus reducing the available reflective surface area of the reflector.

The projection unit described in U.S. Pat. No. 4,219,870 (Haraden et al) was designed as an improvement over the aforedescribed unit of U.S. Pat. No. 4,156,901 by providing means whereby the retention member having the sealed end of the lamp therein may be removed from the front, concave reflecting portion of the glass reflector. The method of removal for these components in U.S. Pat. No. 4,156,901 is through the rear (neck) opening of the reflector. Rearward removal proved difficult in the complete system due to the typically limited accessibility in this region of the system. In U.S. Pat. No. 4,219,870, the resulting unit also requires a metallic "can" on the end of the lamp capsule, as well as the aforementioned grooved, slots, etc. within the opening in the reflector's neck. This opening is substantially smaller, however, than that in U.S. Pat. No. 4,156,901 but in order to accomplish this it is necessary to provide a second, external springlike retention member, as well as grooves in the neck's external surface to accommodate this second member.

In addition to the above, several versions of various front-loading projection units are described in U.S. Pat. Nos. 4,376,967 (Hough), 4,394,189 (Hough et al), and 4,403,276 (Blaisdell), all of which are assigned to the same assignee as the instant invention. All of these units require provision of slots or grooves within the glass reflector's neck portion in order to effect proper alignment of the lamp capsule therein. In addition, all require utilization of a metallic "can" or similar component secured to the end of the capsule (about the sealed end of the lamp itself) which must be inserted within the reflector's neck. As also in the case of the above units, this "can" member includes protuberances or similar projecting portions in order to align the capsule, said protuberances being slidably positioned within the corresponding grooves or slots of the reflector. Still further, the above units require some additional means of accomplishing capsule securement, such as a threaded nut, wireform, or locking cantilever spring member.

Yet another embodiment of a projection unit having a separable lamp capsule is described in U.S. Pat. No. 4,384,319 (Blaisdell et al), which is also assigned to the same assignee as this instant invention. In this unit, the capsule also includes an attached metallic "can" in addition to a pair of projecting flanges which slidably engage both the neck of the reflector and upstanding rear part of the unit's metallic U-shaped holder. Once the capsule was inserted, it is necessary U.S. Pat. No. 4,384,319 to thereafter attach the preferred socket component, which itself constitutes a separate part of the system. It is thus necessary in this unit to precisely locate the flange portions relative to the capsule's filament structure in order to provide proper filament orientation within the reflecting region of the reflector. Such a procedure is understandably both costly and time-consuming.

In U.S. Pat. Nos. 4,389,700 (Blaisdell et al) and 4,390,935 (Audesse et al), there are described two versions of projection units wherein some form of ejector (e.g., pivotal rod, slidable bar member) is utilized to engage the sealed end of the capsule's envelope and eject the capsule through the reflector's forward opening. It is thus necessary for the system operator to have access to the portion of the unit-holder assembly behind the retained reflector in order to accomplish lamp ejection.

In accordance with the teachings of the instant invention, there is defined a projection lamp unit which enables facile ejection of the lamp capsule through the forward opening of the reflector without the need for an ejector bar or similar mechanism, a metallic "can" or the like member secured to the capsule, or an external retention means or the like which must be removably located on the reflector (requiring external slots in the reflector's neck portion), yet which is able to provide precise alignment of the capsule relative to the reflecting surfaces of the reflector. It is believed that such a lamp unit would constitute a significant advancement in the art.

DISCLOSURE OF THE INVENTION

It is, therefore, a primary object of this invention to enhance the projection lamp unit art by providing a lamp unit possessing the aforementioned advantageous features over known units, including those stated above.

In accordance with one aspect of this invention, there is provided a projection lamp unit which comprises a reflector having a concave reflecting portion defining therein a forward opening and a rear neck portion also defining an opening therein, a socket member secured to the reflector (e.g., to an external surface of the neck portion), first and second electrical contacts, each of which includes a female receiving portion positioned substantially within the socket member and a male pin portion extending from the socket, and a lamp which is removably positioned within the socket member through the forward opening of the reflector. The lamp includes an envelope for being located within the concave reflecting portion of the reflector when the lamp is fully inserted within the socket member. The lamp further includes first and second pins which project from a sealed end portion of the envelope and are adapted for being located within the apertures of the first and second contacts, respectively, in a substantially frictional manner such that positive electrical connection is provided between the contact and pin members in addition to alignment of the envelope relative to the defined concave reflecting portion.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
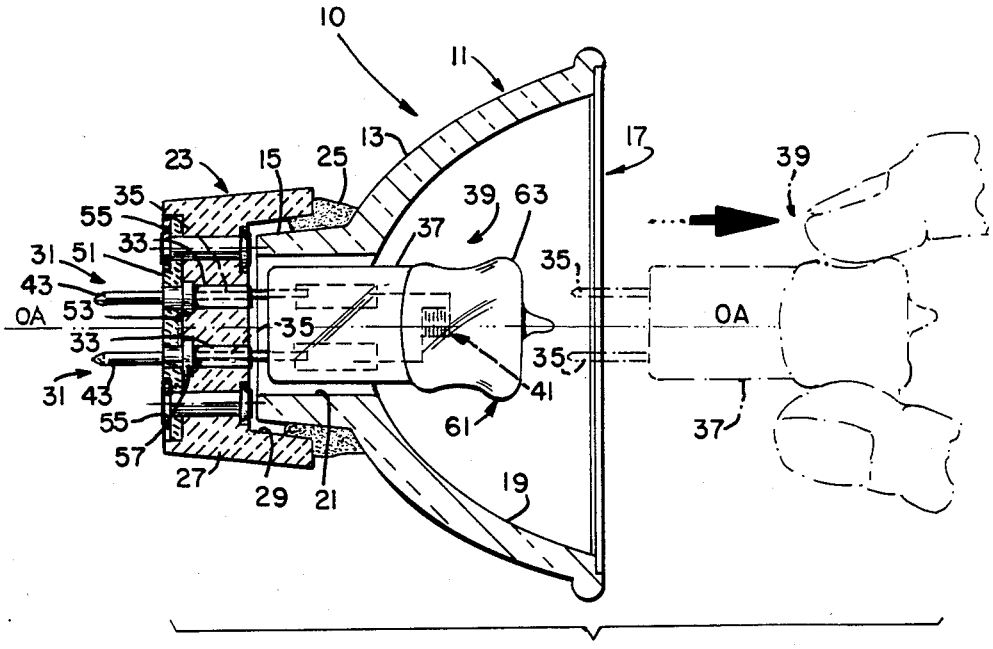
FIG. 1 is a side elevational view, in section, of a projection lamp unit in accordance with one embodiment of the invention.

With particular attention to FIG. 1, there is shown a projection lamp unit 10 in accordance with one embodiment of this invention. Unit 10, as are all of the embodiments defined herein, is adapted for being positioned within a suitable holder (not shown) such as shown and described in the aforementioned U.S. Pat. No. 3,789,212, should it be desired to utilize unit 10 in a slide or movie projection system or the like. Unit 10 is of course also adapted for being positioned within holders or similar members of different configuration depending on the desired use for the unit. One example of such an alternate use is within a track or recessed accent lighting environment.

As shown in FIG. 1, lamp unit 10 includes a reflector 11 which comprises a concave reflecting portion 13 and a rear, neck portion 15 extending therefrom. The forward concave reflecting portion 13 defines a forward opening 17 through which the light from the invention's light source is directed. To provide this capability, the internal reflective walls (surfaces) 19 of the reflector are of either substantially ellipsoidal or parabolic configuration. As shown in FIG. 1, the rear neck portion 15 defines an opening 21 therein which passes entirely through the neck portion. Reflector 11 is preferably of hardglass (e.g., borosilicate) or, alternatively, may be comprised of a suitable, heat-conducting metallic material (e.g., steel). A dichroic coating (not shown) is utilized on the reflective surfaces 19 when the reflector is comprised of glass. Dichroic coatings are known in the art and further description is not believed necessary. In the event a metallic material is utilized for reflector 11, the internal reflective surfaces preferably include a reflective coating (e.g., aluminum) for providing enhanced reflection.

Unit 10 further comprises an insulative socket member 23 which, as shown, is fixedly secured to reflector 11 relative to the rear opening 21 within neck portion 15. As shown in FIG. 1, socket 23 is attached to an external surface of neck portion 15 using a suitable cement (e.g., Sauereisen) known in the art. This cement is illustrated by the numeral 25. Socket 23 is of ceramic material to insure not only electrical insulation but also to enable the unit to be operated at relatively high wattages. Understandably, high wattage applications typically involve high temperatures and the need for a material able to withstand such temperatures. For low wattage applications (e.g., where temperatures do not exceed 260° Celsius), a suitable plastic such as polyphenylene sulphide may be successfully utilized. As shown in FIG. 1, socket 23 includes a main body portion 27 which in turn defines a recess 29 of substantially the same configuration (though somewhat larger) than the neck portion 15. Accordingly, a major part of neck portion 15 is positioned within recess 29.

Spacedly located within socket 23 are a pair of electrical contacts 31. Each contact includes a female receiving portion 33 located substantially entirely within the main body portion 27 of socket 23. Each female receiving portion is designed to accommodate (via insertion) a respect male pin 35 which projects from the press sealed end portion 37 of the tungsten halogen lamp 39 specifically designed for use in the instant invention. More specifically, each female receiving portion 33 includes an aperture therein of substantially the same configuration as that of the corresponding male pin 35 which will be fully inserted within the aperture when lamp 39 is fully positioned within reflector 11. This represents a significant feature of the invention in that this means of engagement must not only assure positive electrical contact between the conductive contacts 31 and male pins 35, but also must assure that precise orientation of lamp 39 within reflector 11 will be achieved such that the lamp's internal filament structure 41 (shown hidden in FIG. 1) will be accurately located at the reflector's focal point (relative to the internal reflecting surfaces 19 of the reflector). To achieve this, the apertures within female receiving portions 33 in one embodiment of the invention possessed an internal diameter of about 0.040 inch while the corresponding male pins 35 each possessed an outer diameter of approximately the same dimension. Accordingly, a frictional fit resulted. In another embodiment of the invention, each female receiving portion contained an internal spring therein for exerting force against the incoming male pin to provide the necessary frictional engagement. In such an arrangement, the aperture within each receiving portion was slightly larger than the corresponding diameter of the male pins. The only depth necessary for each of the cylindrical-shaped apertures within the female receiving portions 33 is that sufficient to allow penetration by the male pins such that subsequent lateral movement of lamp 39 relative to socket 23 will not occur. In other words, the only movement possible for the lamp if proper depth of insertion is accomplished is directly away from the retained contacts (i.e., along optical axis OA—OA of the reflector in a direction to the right in FIG. 1). In one example of the invention, the aforementioned 0.40 inch diameter male pins 35 were located at a depth of about 0.20 inch within each aperture.

Each electrical contact 31 further includes a male pin portion 43 which extends from socket 23 in a direction away from reflector 11 and is adapted for being positioned within a suitable socket component (not shown) which forms part of the projection system's electrical circuit. Located within such a socket member are typically found a corresponding pair of spring contacts or the like. One significant feature of the invention is that its overall dimensions (e.g., overall length) are substantially similar to those of many projection lamp units available on the market today. Accordingly, projection lamp unit 10 is adapted for being positioned within many of today's projection systems as a replacement component.

In one example of the invention, each electrical contact 31 was comprised of silver plated brass and had an overall length of about 0.460 inch. Each female receiving portion 35 was of a cylindrical configuration having an outer diameter of about 0.095 inch while the corresponding male pin portions 43, also of substantially cylindrical configuration, possessed an external diameter of about 0.060 inch. In those embodiments wherein a spring-type form of connection is desired, a heat-treated beryllium copper spring, having a gold plated contact area, is employed within the silver plated brass outer body.

Retention of each of the electrical contacts 31 within socket 23 is achieved in FIG. 1 through the utilization of an insulative back plate member 51 which, as shown, is secured against an external surface 53 of socket 23 by a pair of rivet members 55. Plate member 51 is of mica material to thus assure the sufficient rigidity necessary for such retention in addition to the ability to withstand the relatively high temperatures possible during operation of lamp unit 10. Assembly of socket 23 and electrical contacts 31 is accomplished by firstly positioning each of the contacts 31 within the socket such that a boss portion 57 of each contact engages a corresponding recessed wall within the socket. In FIG. 1, each contact is positioned from the left. Each rivet member 55 is then positioned (from the right) within a corresponding aperture designed to accommodate this element. The mica back plate member 51 is then located over the male pin portions 43 of each contact and the non-crimped end of each rivet. Each end is then crimped to assume the configuration illustrated in FIG. 1. It is understood, of course, that the aforementioned assembly of socket 23 occurs prior to positioning thereof on reflector 11. After such assembly, lamp 39 is inserted within the female receiving portions of each contact. This assembly is thereafter precisely oriented relative to the internal reflecting surfaces 19 of reflector 11 by inserting the envelope portion 61 of lamp 39 through the defined rear opening 21 located within neck portion 15 of the reflector. During such positioning, neck portion 15 will enter the defined recess within socket 23. When lamp 39 is precisely aligned such that its filament structure coincides with the reflector's focal point, securement of socket member 23 (using cement 25) to the neck portion 15 of reflector 11 occurs. The cement 25 is then allowed to cure and a completed assembly has been achieved. It is thus seen that should lamp 39 subsequently fail, removal thereof through the forward opening 17 can be readily and quickly accomplished simply by the system's operator grasping the envelope portion 61 as indicated in phantom in FIG. 1. To facilitate such removal, the envelope portion 61 includes an annular protruding rim portion 63 about the upper end of the envelope. Envelope portion 61 also includes curvilinear side walls between rim portion 63 and sealed end portion 37 to even further facilitate this removal. When the lamp has sufficiently cooled, the system operator has merely to grasp the envelope (using only two fingers) and pull it forward. A similar lamp can then be quickly inserted within socket 23 and the precise alignment and electrical connection assured. As has been described and shown, at no time does lamp 39 physically contact the internal walls of reflector 11 in any manner.

In one embodiment of the invention, lamp 39, in addition to including a coiled tungsten filament structure 41 therein, possessed an overall length of about 1.400 inches. The outermost diameter (of the protruding rim portion 63) of the lamp's envelope was about 0.475 inch. In addition, each of the male pins 35 extended a distance of only 0.200 inch from the bottom edge of the press sealed end 37. Press sealing of lamps of this type is a well known technique, and further definition is not believed necessary. Although an axial coiled filament is depicted in FIG. 1, other filament configurations (e.g., an orthogonal, coiled-coil filament) are of course readily possible.

Figure 2:
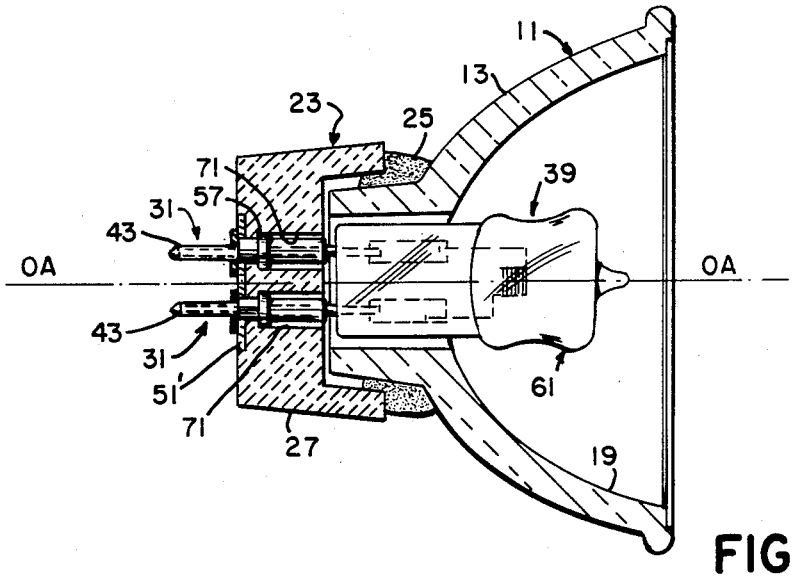
FIG. 2 is a side elevational view, in section, of an alternate embodiment of the invention.

The embodiment of the invention as depicted in FIG. 2 is substantially identical to that of FIG. 1 except for the means of retaining each of the electrical contacts 31 within socket 23. More specifically, each of the contacts 31 is inserted (from the right) within a corresponding aperture 71 until the boss portion 57 thereof engages a corresponding wall within the socket's main body portion 27. A substantially flat mica plate member 51' is then located over the extending male pin portions 43 of each contact until it occupies the illustrated recess within the socket's back wall. Thereafter, each male pin portion 43 is subjected to a crimping operation such that a portion thereof will be slightly deformed in the manner shown to retain the mica plate member 51' in position. Each protruding male pin portion 43 is preferably hollow to facilitate this crimping procedure. Alternatively, a retaining ring or the like could be simply positioned over the male pin portions until engagement with the mica plate member, whereupon each ring could be soldered or welded to the corresponding contact. In yet another acceptable version of this particular embodiment, a hollow, flanged sleeve could be positioned over each male pin portion and subsequently welded or soldered to the pin portion. This latter embodiment is preferred due its relative ease of assembly.

Figure 3:
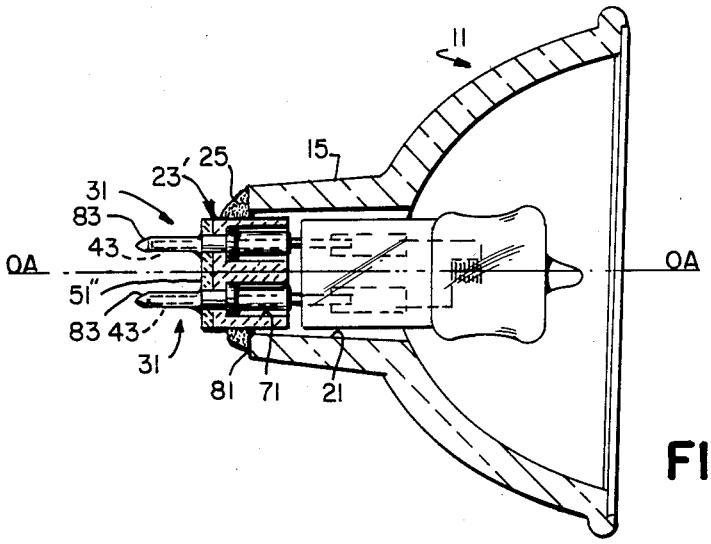
FIG. 3 is a side elevational view, in section, of yet another embodiment of the invention.

The embodiment of FIG. 3 is also substantially identical to that of FIG. 1 except for the design of the socket member. In FIG. 3, socket member 23' is positioned within the rear opening 21 of neck portion 15 of reflector 11 and cemented to the reflector's rear surface 81. Each of the electrical contacts 31 is positioned similarly to those in FIG. 2 (within corresponding apertures 71 located within the socket's body). When each contact is fully inserted, a mica back plate 51" is placed over the male pin portions of each contact and against a planar back surface of the socket. A hollow, flanged sleeve 83 is then placed over the male pin portions 43 of each contact and welded (or soldered) to the contact.

In both of the embodiments depicted in FIGS. 2 and 3, each of the components utilized is preferably of the same materials defined above for the corresponding elements in FIG. 1.

Figure 4:
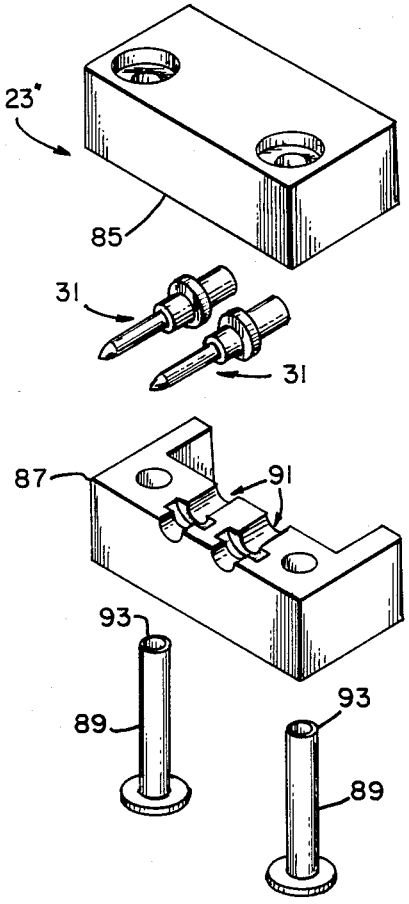
FIG. 4 is an exploded, perspective view of an alternate embodiment of a socket member for use in the invention.

In FIG. 4, there is illustrated an alternate embodiment of a socket member 23" for use with the instant invention. As shown, socket member 23" is of two-part construction, including an upper body portion 85 and a mating, lower body portion 87. Both portions 85 and 87 are held together by a pair of eyelets 89 which pass through corresponding apertures in each portion. Prior to this assembly, each of the desired contacts 31 (preferably similar to those defined in the embodiment of FIG. 1) is positioned within corresponding indentations or recesses 91 within the lower portion 87. Socket member 23" is then oriented relative to the rear neck portion 15 of the reflector and, using eyelets 89, clamped thereabout by crimping the uppermost ends 93 of each eyelet. In such an arrangement, it is also seen that the rear neck portion 15 of the reflector must be of substantially rectangular cross-sectional configuration in order to be positioned within the corresponding rectangular opening defined by the two-part construction shown. It is of course within the scope of this invention to provide a cylindrical opening to in turn accommodate a similarly shaped neck portion.

There has thus been shown and described a projection lamp unit wherein a separable lamp capsule capable of being readily removed from the reflector's forward opening is utilized. Such removal is possible without the necessity of an ejector bar or rod member or the like, a releasable "can" member fixedly secured to the end portion of the lamp capsule, etc. Such removal is also possible without the necessity of reaching behind the reflector to engage such components.

While there have been shown and described what are at present considered to be the preferred embodiments of the invention, it will be apparent to those skilled in the art that various changes and modifications may be made therein without departing from the scope of the invention as defined by the appended claims.

What is claimed is:

1. A projection lamp unit comprising:

a reflector having a concave reflecting portion defining a forward opening and a rear, neck portion defining a rear opening therein;

a socket member fixedly secured to said reflector relative to said rear opening within said rear neck portion thereof;

first and second electrical contacts, each of said contacts including a female receiving portion spacedly positioned within said socket member and having an aperture therein and a male pin portion extending from said socket; and a lamp removably positioned within said socket member through said forward opening of said reflector, said lamp including an envelope for being located substantially within said concave reflecting portion of said reflector when said lamp is fully inserted within said socket member, said envelope including a sealed end portion and a protruding rim portion to enable said envelope to be manually grasped and removed from said socket member through said forward opening of said reflector, and first and second pins projecting from said sealed end portion of said envelope, said first and second pins being located within said apertures within said female receiving portions of said first and second contacts, respectively, in a substantially frictional manner to provide positive electrical connection between said contacts and said pins and alignment of said envelope relative to said concave reflecting portion when said lamp occupies said fully inserted position within said socket member.

2. The projection lamp unit of claim 1 wherein said socket member is located substantially within said rear opening within said rear, neck portion of said reflector.

3. The projection lamp according to claim 1 wherein said envelope of said lamp includes curvilinear side walls to further facilitate said manual grasping of said envelope and removal of said lamp from said socket member.

4. The projection lamp unit of claim 1 wherein said lamp does not physically contact said reflector when said lamp occupies said fully inserted position within said socket member.

5. The projection lamp unit of claim 1 wherein the material of said reflector is selected from the group consisting of metal and glass and the material of said socket member is selected from the group consisting of ceramic and plastic.

6. The projection lamp unit of claim 1 wherein said lamp is a tungsten halogen lamp having a coiled tungsten filament therein.

7. The projection lamp unit of claim 1 further including a plate member secured to an external surface of said socket member for retaining said first and second contacts within said socket member.

8. The projection lamp unit of claim 1 wherein said socket member is located externally of said rear neck portion of said reflector.

9. The projection lamp unit of claim 8 wherein said socket member is fixedly secured to said rear neck portion.

10. The projection lamp unit of claim 9 wherein said socket member is of two-part construction, said parts secured together substantially about said rear, neck portion.

* * * * *